US011617430B2

(12) United States Patent
Werz

(10) Patent No.: US 11,617,430 B2
(45) Date of Patent: Apr. 4, 2023

(54) BAG OR RUCKSACK

(71) Applicant: ADVENATE GmbH, St. Johann (DE)

(72) Inventor: Matthias Werz, Engstingen (DE)

(73) Assignee: ADVENATE GmbH, St. Johann (DE)

( * ) Notice: Subject to any disclaimer, the term of this patent is extended or adjusted under 35 U.S.C. 154(b) by 59 days.

(21) Appl. No.: 17/408,553

(22) Filed: Aug. 23, 2021

(65) Prior Publication Data

US 2022/0061505 A1 Mar. 3, 2022

(30) Foreign Application Priority Data

Aug. 27, 2020 (DE) ..... 10 2020 122 461.3

(51) Int. Cl.
*A45F 3/04* (2006.01)
*A45C 7/00* (2006.01)
*A45C 13/30* (2006.01)

(52) U.S. Cl.
CPC ..... *A45F 3/04* (2013.01); *A45C 7/0063* (2013.01); *A45C 7/0068* (2013.01); *A45C 2013/306* (2013.01)

(58) Field of Classification Search
CPC ..... A45F 3/04; A45C 7/0027; A45C 7/0022; A45C 7/0031; A45C 7/0063; A45C 7/0068; A45C 7/0072; A45C 2013/306
USPC ..... 224/581–583
See application file for complete search history.

(56) References Cited

U.S. PATENT DOCUMENTS 4,334,601 A * 6/1982 Davis ..... A45C 3/00 190/111
5,743,447 A * 4/1998 McDermott ..... A45C 7/0086 224/583
5,799,851 A * 9/1998 Wulf ..... A45F 3/047 224/582
5,826,771 A 10/1998 Peng
6,015,072 A 1/2000 Young
6,053,382 A * 4/2000 Wyant ..... A45C 7/0068 190/103
6,659,320 B1 * 12/2003 Alves ..... A45F 3/04 224/652

(Continued)

FOREIGN PATENT DOCUMENTS

BR 102015018632 A2 3/2018

OTHER PUBLICATIONS

European Search Report dated Jan. 24, 2022 issued in the corresponding EP Application Serial No. 21 18 9904 (with English translation).

*Primary Examiner* — Scott T McNurlen
(74) *Attorney, Agent, or Firm* — Collard & Roe, P.C.

(57) ABSTRACT

A bag or a rucksack has a base part having an enlargeable packing volume and first and second connection elements, between which a flexible wall element is arranged. A first packing volume is formed when the first and second connection elements are connected and the wall element is arranged in the first packing volume at least in part, and an expanded packing volume is formed when the first and second connection elements are separated. An additional part is provided which has an additional packing volume, and a first additional connection element is provided on the wall element and a second additional connection element is provided on the additional part. The additional part can be fastened to the base part by means of the additional connection elements.

11 Claims, 4 Drawing Sheets

(56) References Cited

U.S. PATENT DOCUMENTS

| | | | | |
|---|---|---|---|---|
| 7,594,569 | B2 * | 9/2009 | Bass | A45C 7/0086 190/902 |
| 7,942,296 | B1 * | 5/2011 | Johnson | A45C 7/0086 224/652 |
| 10,653,230 | B1 | 5/2020 | Wang | |
| 2004/0026199 | A1 | 2/2004 | Chen | |
| 2005/0045673 | A1 * | 3/2005 | Godshaw | A45C 7/0036 224/153 |
| 2006/0102673 | A1 * | 5/2006 | Collier | A45C 7/0068 190/103 |
| 2007/0045370 | A1 * | 3/2007 | Hsieh | A45F 3/04 190/110 |

* cited by examiner

BAG OR RUCKSACK

CROSS REFERENCE TO RELATED APPLICATIONS

Applicant claims priority under 35 U.S.C. § 119 of German Application No. 10 2020 122 461.3 filed Aug. 27, 2020, the disclosure of which is incorporated by reference.

BACKGROUND OF THE INVENTION

1. Field of the Invention

The invention relates to a bag or a rucksack comprising a base part having an enlargeable packing volume, the base part comprising a first and a second connection element, between which a flexible wall element is arranged, and a first packing volume being formed when the first and second connection element are connected, and the wall element being arranged in the first packing volume, at least in part, and an enlarged packing volume being formed when the first and second connection element are separated.

2. Description of the Related Art

Previous enlarging principles for bags and rucksacks are known for example from US Patent Application Publication No. 2004/0026199 A1. These enlarging functions are characterized in that an additional volume can be attached to a basic bag or a basic rucksack. The additional volume should provide users with additional storage space, and is attached to the basic item of luggage via a connecting zip fastener. This one-step enlargement function is associated with various disadvantages. Firstly, the user cannot react flexibly to the packing requirement, because the additional volume can be enlarged only by one step. Furthermore, previous approaches do not provide a solution for the problem of the connecting zip fastener, to which the additional volume is connected, remaining exposed for reasons of design. This is disadvantageous in that the zip fastener can be damaged or the function thereof can be impaired by contamination. Moreover, an exposed zip fastener has optical and aesthetic disadvantages.

This problem can be solved in that special covers are provided. For example, when no additional volume is fastened thereto a cover can be zipped onto the zip fastener, in order to cover the connecting zip fastener. This results in a very laborious and inappropriate use for the user. Whenever the volume is intended to be changed, the user has to first remove one part (cover or additional volume) and then in turn, in the next step, fasten a part (cover or additional volume).

Furthermore, for example suitcases are known, the volume of which can be enlarged in that a zip fastener is opened and in that a previously folded wall region is released for unfolding. Here, too, there is just one possibility for enlarging the volume of the suitcase.

SUMMARY OF THE INVENTION

It is therefore an object of the invention to provide a bag or a rucksack, the packing volume of which is flexibly enlargeable.

This object is achieved according to the invention by a bag or a rucksack comprising a base part having an enlargeable packing volume, the base part comprising a first and a second connection element, between which a flexible wall element is arranged, and a first packing volume being formed when the first and second connection element are connected and the wall element being arranged in the first packing volume, at least in part, and an enlarged packing volume being formed when the first and second connection element are separated, an additional part being provided which comprises an additional packing volume, and a first additional connection element being provided on the wall element and a second additional connection element being provided on the additional part, the additional part being able to be fastened to the base part via the additional connection elements.

The packing volume of the bag according to the invention or of the rucksack according to the invention can thus be expanded in two steps. In a first step the first and second connection element can be separated from one another, such that the wall element can expand, which wall element is folded or collapsed when the connection elements are connected. The wall element is thus a part of the wall or covering of the base part which defines the packing volume of the first base part. The wall element can for example be formed of leather, synthetic leather, plastics material, in particular a tarpaulin, or a textile, in particular fabric, woven fabric, knitted fabric, or the like, at least in part. In particular, the wall element can be formed of a flexible material.

A second enlargement of the packing volume results when the additional part is fastened to the first additional connection element. The overall assembly then has a larger packing volume.

Particular advantages result when the first additional connection element, in the case of connected connection elements, is completely protected in a pocket or fold formed by the wall element. In particular when the first and second connection element are connected to one another said elements are located above the first additional connection element such that the additional connection element is completely protected from external influences. The above-described disadvantages can be overcome thereby.

The base part and the additional part respectively can comprise at least one closable access opening for the respective packing volume. Thus, the packing volume of the base part and of the additional part are accessible separately, via one access opening in each case. For example, the access openings can be closed by a zip fastener in each case.

A particularly simple and reliable embodiment of the invention results when the connection elements and/or the additional connection elements are formed as part of a respective zip fastener. In principle, however, other types of connection elements are also conceivable. For example, the connection elements and/or additional connection elements may comprise plug elements, fasteners, lugs, etc., or be designed as such at least in part.

At least one compression strap comprising a closure element, which can be connected to a corresponding closure element on the base part, can be arranged on the base part. The packing volume can be additionally adjusted by means of a compression strap of this kind. However, further objects can also be fastened to the bag or the rucksack by means of the compression strap.

Particular advantages result when a closure element corresponding to the closure element of the compression strap is arranged on the additional part. Thus, the compression strap can selectively be connected, by the closure element thereof, to the closure element of the base part or to the closure element of the additional part. In particular when the additional part is arranged on the base part, it is thus possible for the entire volume of the bag or of the rucksack to be readjusted via the compression strap.

The closure elements can be designed as male and female parts of a plug-in system.

Particular advantages result when two or three compression straps are provided with appropriate closure elements which are associated with corresponding closure elements on the base part and/or additional part.

The additional connection elements can extend only along one or more (separated) portions of a connection region of the base part and additional part. It is thus possible to also insert objects between the base part and the additional part. For example, a jacket can be inserted into this region and is thus easily and simply accessible. Furthermore, the additional part and base part can be interconnected more quickly when the additional connection elements extend only over a portion, since as a result for example a zip fastener can be closed more quickly on account of the shorter length. In this case, the connection region is the region in which the additional part covers the base part and/or is in (full-surface) contact therewith. The additional connection elements can extend along the edge of said connection region.

However, a particularly reliable connection of the additional part to the base part results when the first additional connection element extends over the entire periphery of the base part, and/or the second additional connection element extends over the entire periphery of the additional part.

In particular, the first additional connection element can extend in an annular manner. This means that the start and the end of the first additional connection element are arranged close to one another and almost touch one another. In the case of such an embodiment of the first additional connection element, a particular good and reliable connection of the base part and additional part results.

The additional connection element can be located in the region of the base of the base part. It is thus possible to attach an additional part at the bottom of the base part. For example, the additional part can be fastened to the base part, in this way, in the form of a camera bag.

At least one closable pocket can be arranged on the base part and/or an additional part. In particular, the pocket can extend into the relevant packing volume and be closable by means of a zip fastener. It is thus possible in particular for smaller objects, which have to be quickly accessible, to be stored.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
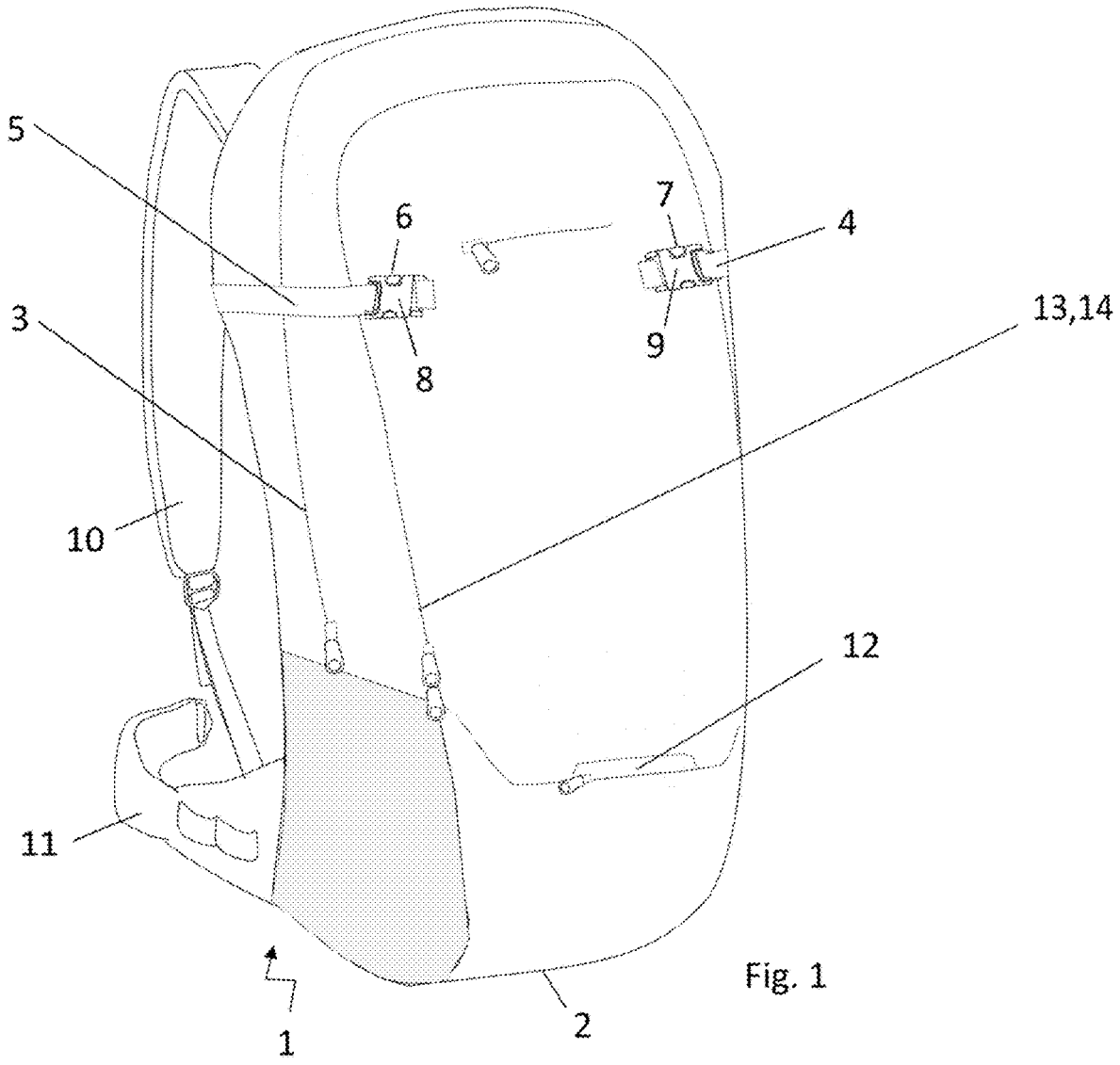
FIG. 1 shows a rucksack having a first packing volume.

FIG. 1 shows a rucksack 1 comprising a base part 2 which defines a first packing volume. The interior, and thus the packing volume, of the base part 2 is accessible via a closable access opening 3. In the embodiment shown, the access opening 3 is closable by means of a zip fastener.

Compression straps 4, 5 are provided on the base part 2, on which straps a closure element 6, 7 is arranged in each case which cooperates with corresponding closure elements 8, 9 on the base part 2. A fine adjustment of the packing volume of the rucksack 1 can be carried out by means of the compression straps 4, 5. The rucksack 1 further comprises a shoulder strap 10 and a waist strap 11. In order to be able to more easily store utensils, a pocket 12 which can be closed by a zip fastener, or a compartment, is provided on the base part 2.

Figure 2:
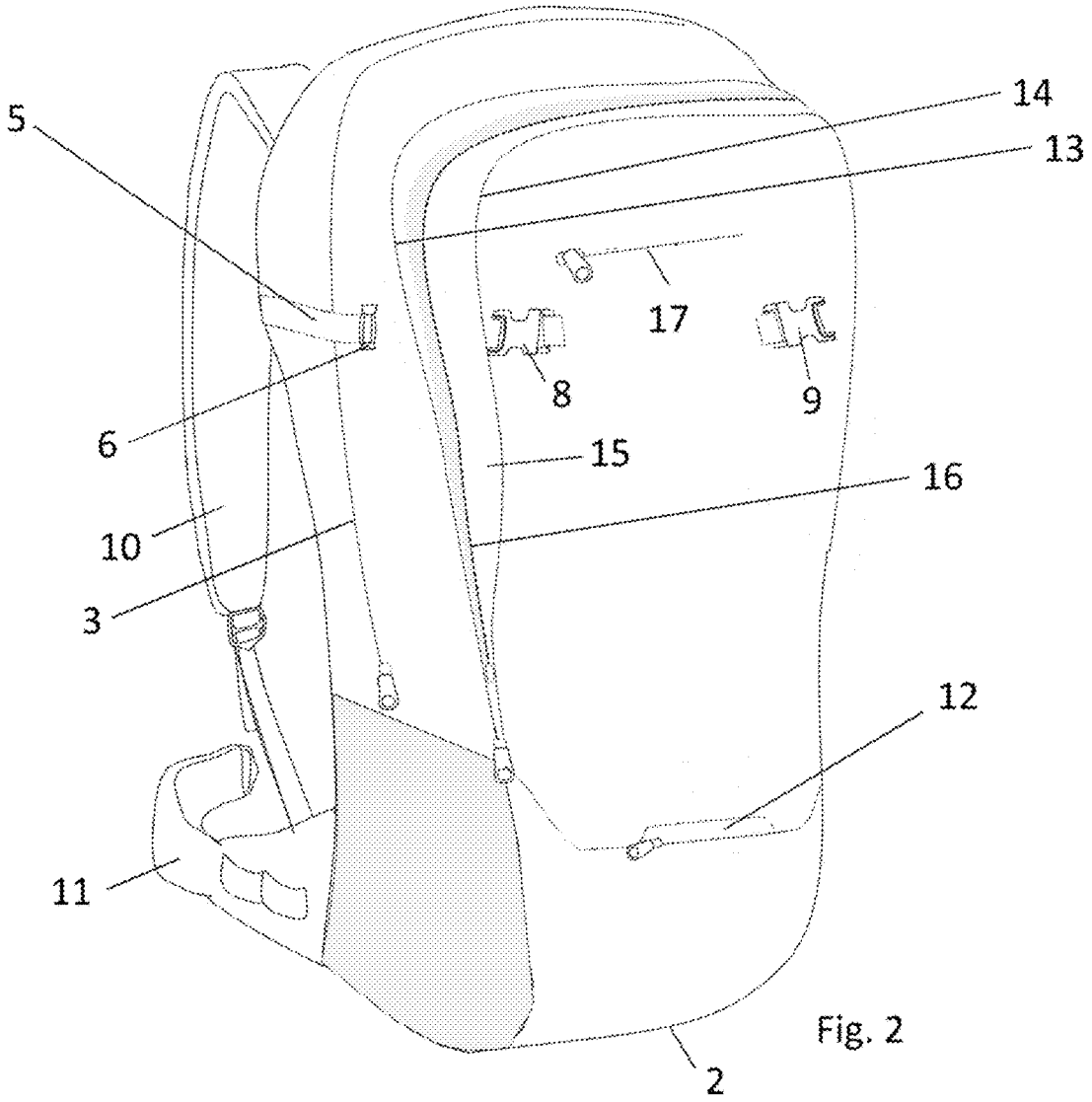
FIG. 2 shows a rucksack having a second packing volume.

In order to enlarge the packing volume, closure elements 13, 14, which in this case form a zip fastener, are provided. If the closure elements 13, 14 are released from one another, as can be seen in FIG. 2, a wall element 15, arranged between the closure elements 13, 14 and made of a flexible material, can unfold. The packing volume of the base part 2 is enlarged as a result. Since, in the embodiment shown, the connection elements 13, 14 do not extend in a completely annular manner, i.e. the ends do not touch or are not arranged close together, the wall part 15 does not have a uniform width, but rather is designed so as to be wedge-shaped in the end regions thereof or tapers to a point in the end regions thereof. It would also be conceivable, however, to design the connection elements 13, 14 so as to be longer, such that the ends thereof almost touch. In this case, the wall element 15 could be designed having a constant width, and the packing volume could be enlarged yet further.

Figure 3:
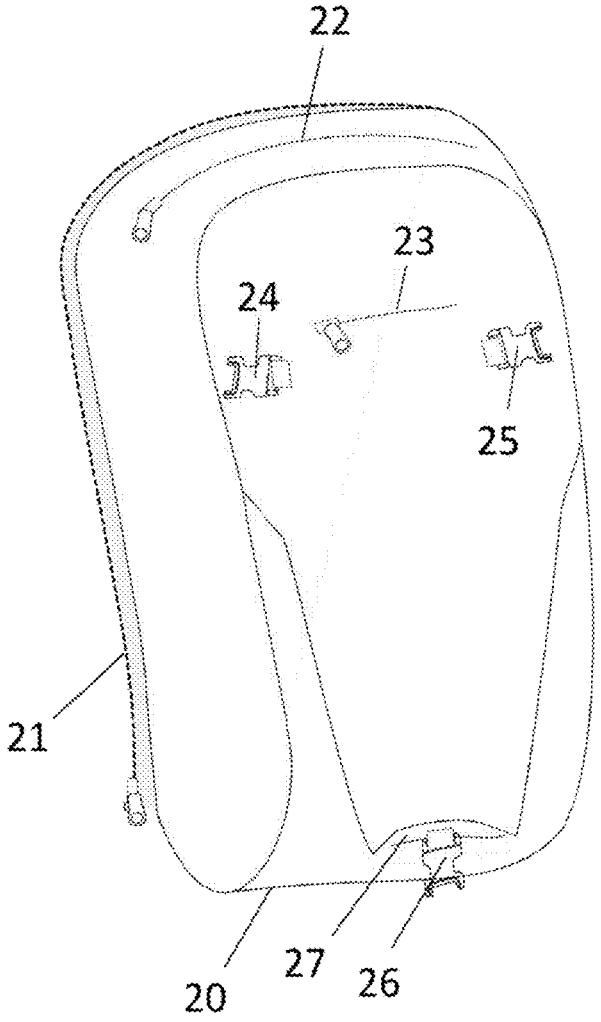
FIG. 3 shows an additional part of the rucksack.

A first additional connection element 16 is arranged on the wall element 15. Said first additional connection element 16 is used for connection to an additional part (FIG. 3). It is furthermore visible, in FIG. 2, that the closure elements 6, 8, 7, 9 have been released from one another. It can in addition be seen that a further closable pocket 17 is arranged in the upper region of the base part 2.

FIG. 3 shows an additional part 20 which defines an additional packing volume. The additional part 20 comprises a second additional connection element 21 to which the first additional connection element 16 can be connected. In this way, the additional part 20 can be fastened to the base part 2, and the packing volume of the rucksack 1 can be enlarged.

The additional part 20 also comprises an access opening 22, which is in particular closable by means of a zip fastener. Furthermore, the additional part 20 comprises a pocket 23 or compartment, which is in particular closable by means of a zip fastener. Closure elements 24, 25 are provided for cooperating with the closure elements 6, 7 at the ends of the compression straps 4, 5.

A further closure element 26, which can cooperate with a further closure element on the base part 2, is located at the lower end of the additional part 20. The closure elements can be designed as clasps for example.

A further closable pocket 27 is provided in the region of the closure element 26.

It can be seen, in this case, that the second additional connection element 21 is not peripheral, but rather is arranged just in one portion. Thus, a region remains in which the additional part 20 is not connected to the base part 2. In this region, which in this case is located at the lower end of the additional part 20, objects can be pushed between the base part 2 and the additional part 20. Said objects can for example be secured by a compression strap, the closure element of which cooperates with the closure element 26.

Figure 4:
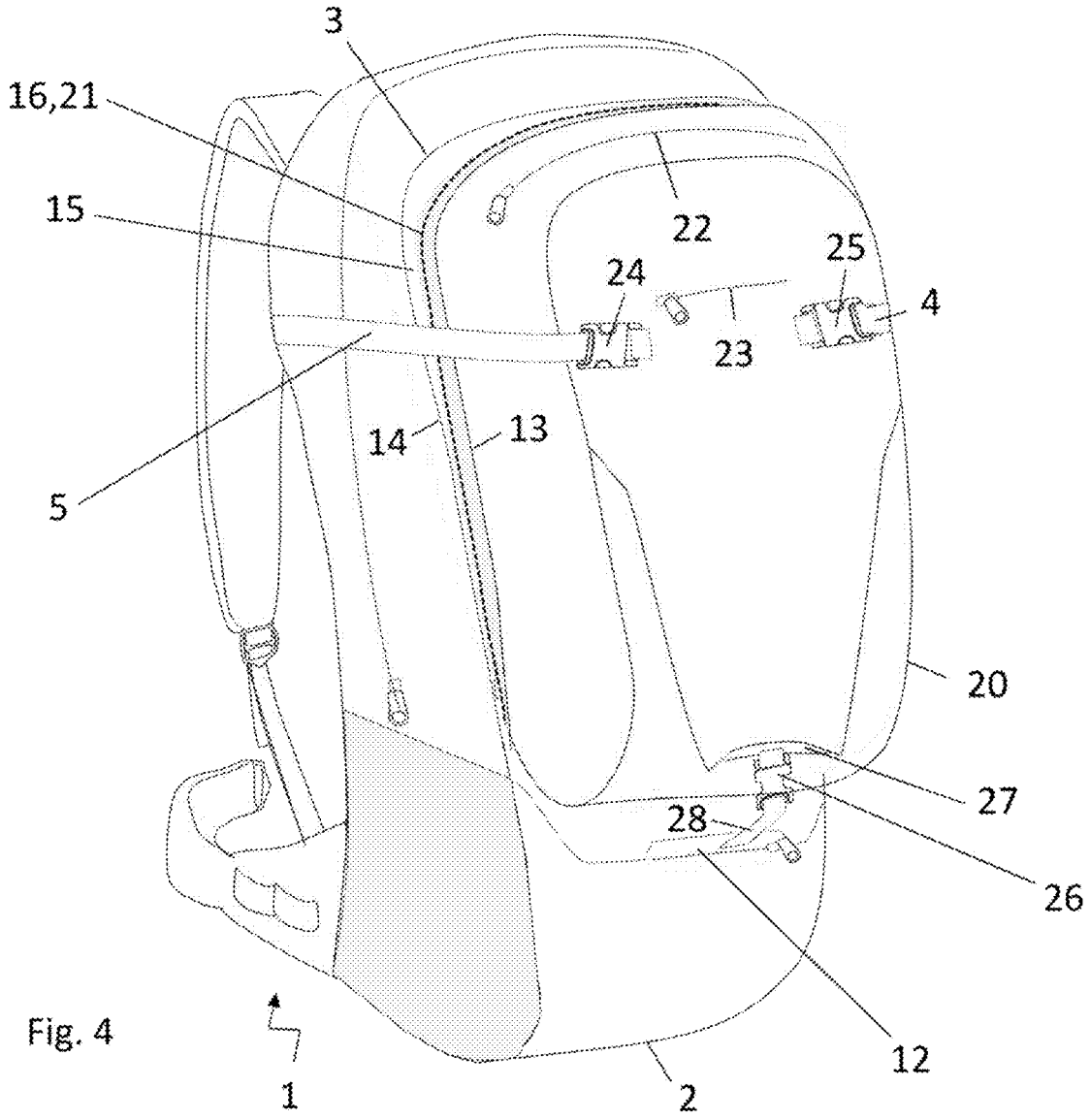
FIG. 4 shows the rucksack comprising the additional part.

FIG. 4 now shows the rucksack 1, in which the additional part 20 is connected to the base part 2. The compression straps 4, 5 were connected to the connection elements 24,

25, such that fine adjustment of the packing volume can be carried out. In this case, it can also be seen that the closure element 26 is connected to a closure element arranged on a further compression strap 28.

Although only a few embodiments of the present invention have been shown and described, it is to be understood that many changes and modifications may be made thereunto without departing from the spirit and scope of the invention.

What is claimed is:

1. A bag or rucksack comprising:

a base part having an enlargeable packing volume, the base part comprising a first connection element, a second connection element, and a flexible wall element arranged between the first connection element and the second connection element, wherein a first packing volume is formed when the first connection element and second connection element are connected to each other, and the wall element is arranged in the first packing volume at least in part, and wherein an expanded packing volume is formed when the first connection element and second connection element are separated, and an additional part which has an additional packing volume, wherein a first additional connection element is provided on the wall element and a second additional connection element is provided on the additional part, wherein the additional part is configured to be fastened to the base part by means of the first and second additional connection elements.

2. The bag or rucksack according to claim 1, wherein when the first and second connection elements are connected, the first additional connection element is arranged so as to be completely protected in a pocket or fold formed by the wall element.

3. The bag or rucksack according to claim 1, wherein the base part and the additional part respectively comprise at least one closable access opening to the respective packing volume.

4. The bag or rucksack according to claim 1, wherein the connection elements and/or the additional connection elements are formed as parts of a respective zip fastener.

5. The bag or rucksack according to claim 1, further comprising at least one compression strap comprising a closure element arranged on the base part, which closure element can be connected to a corresponding closure element on the base part.

6. The bag or rucksack according to claim 5, wherein a further closure element which corresponds to the closure element of the compression strap is arranged on the additional part.

7. The bag or rucksack according to claim 1, wherein the additional connection elements extend only along one or more separated portions of a connection region of the base part and additional part.

8. The bag or rucksack according to claim 1, wherein the first additional connection element extends over an entire periphery of the base part, and/or the second additional connection element extends over an entire periphery of the additional part.

9. The bag or rucksack according to claim 1, wherein the first additional connection element extends in an annular manner.

10. The bag or rucksack according to claim 1, wherein the first additional connection element is arranged in a region of a base of the base part.

11. The bag or rucksack according to claim 1, wherein a closable pocket is arranged on the base part and/or on the additional part.

* * * * *